US006152743A

United States Patent [19]

Fox

[11] Patent Number: 6,152,743

[45] Date of Patent: Nov. 28, 2000

[54] COAXIAL CONNECTORS WITH INTEGRAL ELECTRONIC COMPONENTS

[75] Inventor: Ronald S. Fox, Bolingbrook, Ill.

[73] Assignee: Berg Technology, Inc., Reno, Nev.

[21] Appl. No.: 09/349,642

[22] Filed: Jul. 8, 1999

[51] Int. Cl.[7] ..... H01R 9/09

[52] U.S. Cl. ..... 439/63; 439/620

[58] Field of Search ..... 439/63, 381, 620, 439/944

[56] References Cited

U.S. PATENT DOCUMENTS

| | | | |
|---|---|---|---|
| 4,329,665 | 5/1982 | Kawai et al. | 333/182 |
| 4,672,342 | 6/1987 | Gartzke | 333/260 |
| 4,795,991 | 1/1989 | Saito et al. | 333/181 |
| 4,797,120 | 1/1989 | Ulery | 439/578 |
| 5,062,811 | 11/1991 | Hackman | 439/620 |
| 5,326,280 | 7/1994 | Briones et al. | 439/581 |
| 5,340,325 | 8/1994 | Pai | 439/188 |
| 5,403,207 | 4/1995 | Briones | 439/620 |
| 5,413,504 | 5/1995 | Kloecker et al. | 439/620 |
| 5,476,394 | 12/1995 | Sugihara et al. | 439/620 |
| 5,557,068 | 9/1996 | Chung | 174/59 |
| 5,587,884 | 12/1996 | Raman | 361/728 |
| 5,639,262 | 6/1997 | Lim | 439/607 |
| 5,647,767 | 7/1997 | Scheer et al. | 439/620 |
| 5,687,233 | 11/1997 | Loudermilk et al. | 379/442 |
| 5,730,612 | 3/1998 | Tatsuzuki | 439/188 |
| 5,759,067 | 6/1998 | Scheer | 439/607 |
| 5,775,927 | 7/1998 | Wider | 439/188 |
| 6,045,406 | 4/2000 | Cortes | 439/620 |
| 6,053,743 | 4/2000 | Mitchell et al. | 439/63 |

OTHER PUBLICATIONS

"T1/E1/ISDN–PRI Surface Mount Transformers"; Midcom, Inc. website, pp. 1–2, May 21, 1999.

"Midcom's 50480Y: low percent–power isolation"; Midcom, Inc. catalog, 3 pages, Dec. 31, 1998.

*Primary Examiner*—Steven L. Stephan
*Assistant Examiner*—Phuong Dinh
*Attorney, Agent, or Firm*—Woodcock Washburn Kurtz Mackiewicz & Norris LLP

[57] ABSTRACT

A coaxial connector that is mountable to a substrate is disclosed. The coaxial connector includes an electrically conductive inner contact for conducting a signal through the connector, an electrically conductive outer shell disposed generally coaxially around the inner contact, and an insulator disposed between the inner contact and the outer shell for insulating the inner contact electrically from the outer shell. The connector also includes an integral electronic component, such as a transformer, disposed within the outer shell. The electronic component has a first terminal in electrical contact with the inner contact, a second terminal in electrical contact with the outer shell, and a third terminal, isolated from the first and second terminals, adapted for electrical contact to the substrate.

15 Claims, 9 Drawing Sheets

COAXIAL CONNECTORS WITH INTEGRAL ELECTRONIC COMPONENTS

FIELD OF THE INVENTION

This invention relates to electrical connectors. More particularly, the invention relates to a coaxial connector having an integral electronic component therein, such as a transformer.

BACKGROUND OF THE INVENTION

Coaxial connectors are used, for example, to connect a signal generating apparatus to a signal receiving apparatus. Conventional coaxial connectors include an inner conductor or contact, an outer conductor or shell, and an insulator disposed between the inner contact and the outer shell. The size, shape, and arrangement of these various components can vary significantly. For example, some coaxial connectors have both their inner and outer conductors axially aligned with one another along the respective lengths of the connectors. Other mateable pairs of coaxial connectors comprise at least one connector that extends through a right angle. Some coaxial connectors are mounted directly to the signal generating or signal receiving apparatus. Other coaxial connectors are mounted to a coaxial cable which, in turn, extends to the apparatus. Some coaxial connectors are constructed for easy push-pull mating and unmating. Others are mated with a threaded coupling nut.

A bayonet navy connector (BNC) is one such coaxial cable connector having an inner contact and an outer shell. The outer shell is connected to a cable shield that is, ideally, at ground potential. Because shielded cables prevent radiofrequency (RF) emissions from the cable, BNCs are often used for high frequency communications, such as local area network (LAN) systems. Distinguishing features of the BNC include its bayonet coupling for ease of connection, and a small profile, which is critical in LAN applications due to small size and component densities.

One advantage of a coaxial connector is that a signal provided to the signal generating or signal receiving apparatus is shielded to prevent noise from degrading the signal. Typically, the signal generating or signal receiving apparatus comprises a substrate, such as a printed circuit board (PCB), onto which the coaxial connector is mounted. A typical coaxial connector is electrically connected, via traces on the PCB, to other electronic components, such as transformers, capacitors, light emitting diodes (LEDs), or the like, that are also mounted on the PCB.

It is known in the art that the voltage standing wave ratio (VSWR) performance of an electrical system mounted onto a PCB is adversely affected as signals traverse the traces between components. Thus, it would be advantageous to reduce the number of, or even to eliminate, the traces on the PCB that electrically connect the coaxial connector with other electronic components.

Moreover, as the need for smaller PCBs become more critical, it would be advantageous to use the space available on the PCB more efficiently by reducing the amount of space required to mount the same number of components (i.e., by increasing component density).

SUMMARY OF THE INVENTION

The above described needs in the art are satisfied by coaxial connectors having integral electronic components such as transformers, capacitors, LEDs, etc., which are mountable to a substrate such as a printed circuit board (PCB).

The connector of the present invention includes an electrically conductive inner contact for conducting a signal through the connector, an electrically conductive outer shell disposed generally coaxially around the inner contact, and an insulator disposed between the inner contact and the outer shell for insulating the inner contact electrically from the outer shell. The outer shell and the inner contact each can include a mating portion having a cylindrical outer surface about the connector's axis. The outer shell can also include a plurality of posts for mounting the connector onto a substrate. The posts can be adapted, for example, to be press-fit into a through hole on the substrate.

The connector of the present invention also includes an electronic component, such as a transformer, capacitor, LED, or the like, disposed within the outer shell. The electronic component has a first terminal in electrical contact with the inner contact, a second terminal in electrical contact with the outer shell, and a third terminal, isolated from the first and second terminals, adapted for electrical contact to the substrate. At least one terminal of the electronic component can be adapted to be surface mounted onto the substrate.

The inner contact includes a receiving portion into which the first terminal of the electronic component is received. Similarly, the insulator includes a contact receiving portion, which has a cylindrical outer surface about the connector's axis, into which a mating portion of the inner contact is received. The insulator can also include a component receiving portion into which the electronic component is received such that the insulator holds the electronic component and the inner contact in place within the outer shell.

The connector can also include a second insulator disposed between the electronic component and the outer shell that holds the electronic component in place within the outer shell, and a knurl ring, disposed between the contact receiving portion of the insulator and the outer shell, that holds the insulator in place within the outer shell.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an embodiment that is presently preferred, it being understood, however, that the invention is not limited to the specific methods and instrumentalities disclosed. In the drawings.

DETAILED DESCRIPTION OF PREFERRED EMBODIMENTS

Figure 1:
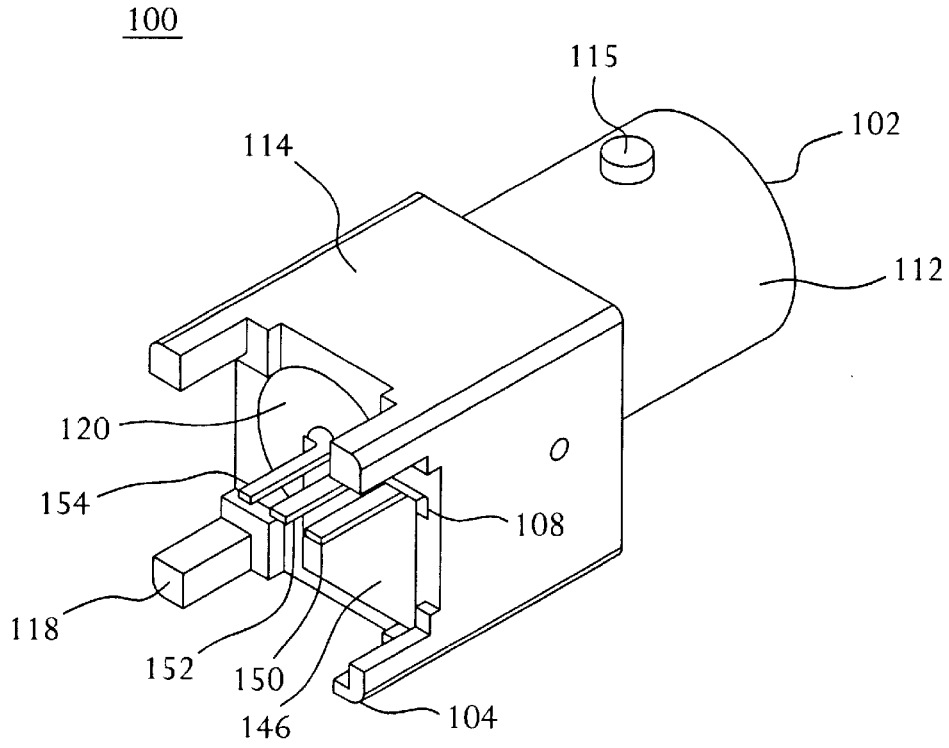
FIG. 1 is an isometric view of a preferred embodiment of a coaxial connector according to the present invention.

For the purposes of promoting an understanding of the principles of the invention, reference will now be made to the preferred embodiments illustrated in the drawings and specific language will be used to describe the same. It should be understood, however, that no limitation of the scope of the invention is thereby intended. For example, while the figures depict a male BNC, it should be understood that the invention can be applied to any coaxial connector, including female connectors. Moreover, it should be understood that coaxial connectors having integral transformers are presented solely for purposes of illustration, and that the invention is in no way limited thereto. It is contemplated that other electronic components, such as capacitors, LEDs, or the like, can also be integrated into a coaxial connector according to the present invention.

Figure 2A:
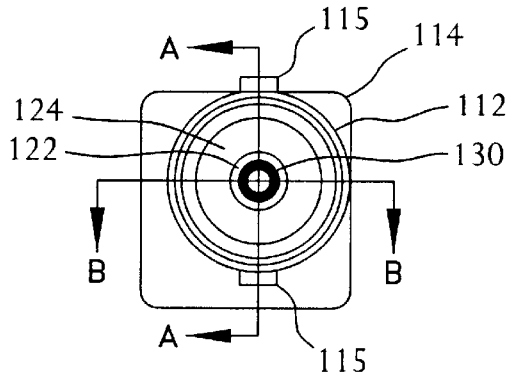
FIGS. 2A and 2B are end views of the connector shown in FIG. 1.
Figure 2B:
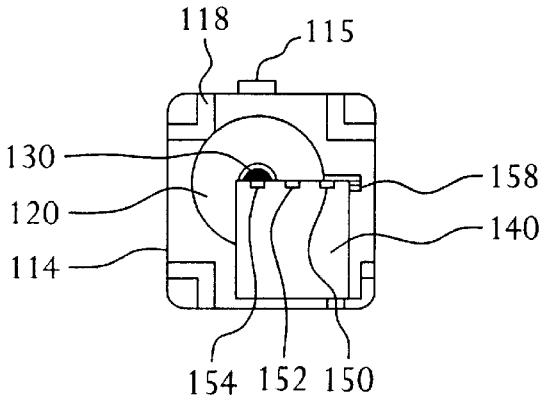
Figure 3:
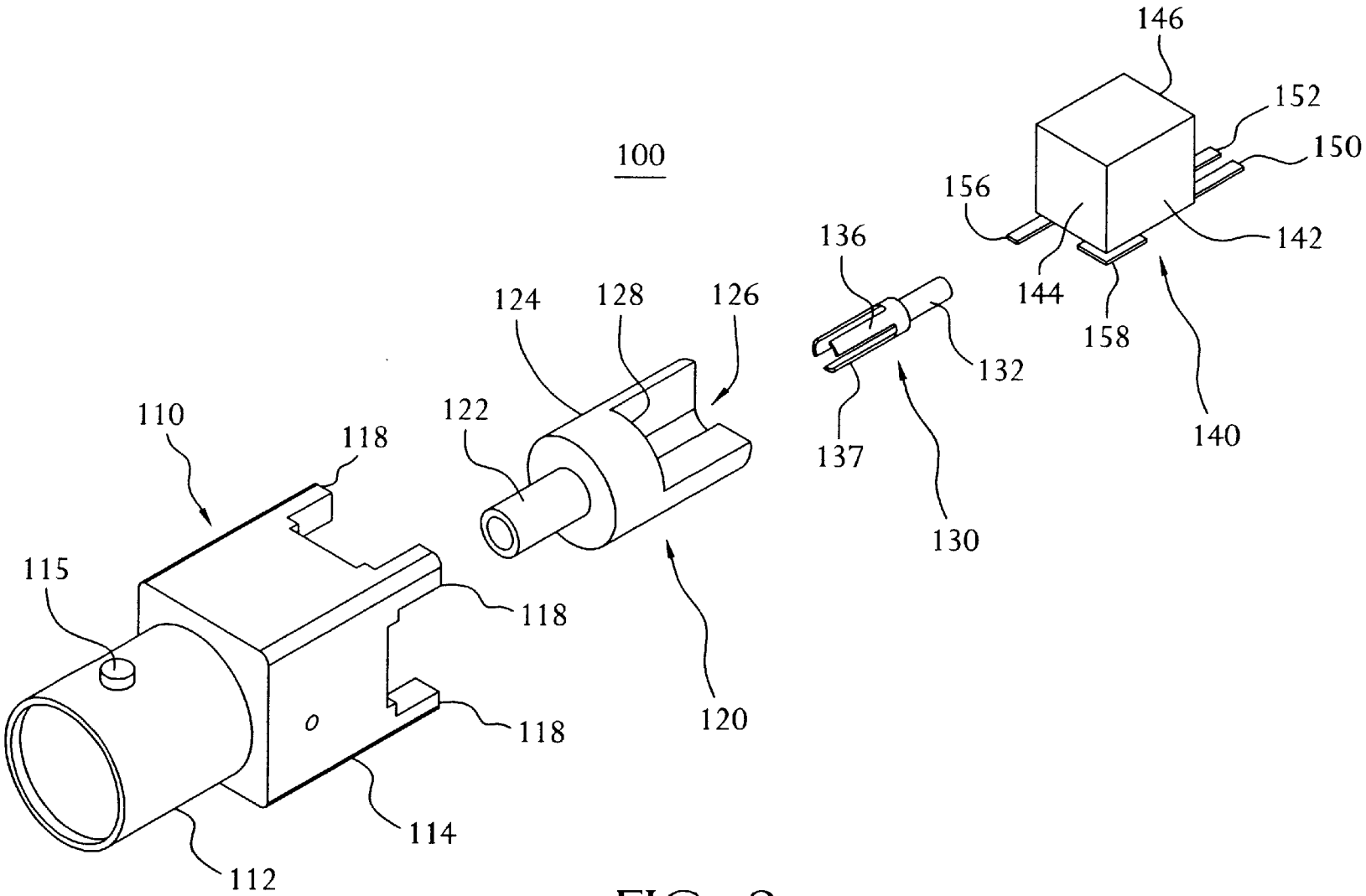
FIG. 3 is an exploded view of the connector of FIG. 1.
Figure 4A:
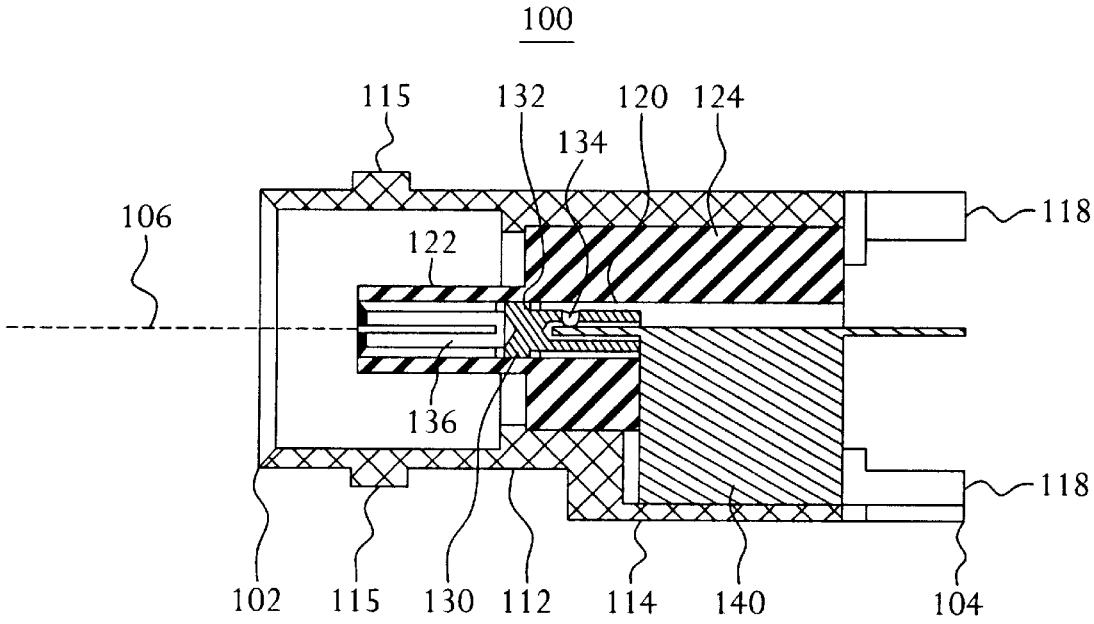
FIGS. 4A and 4B are axial cross-sectional views of the connector shown in FIG. 1.
Figure 4B:
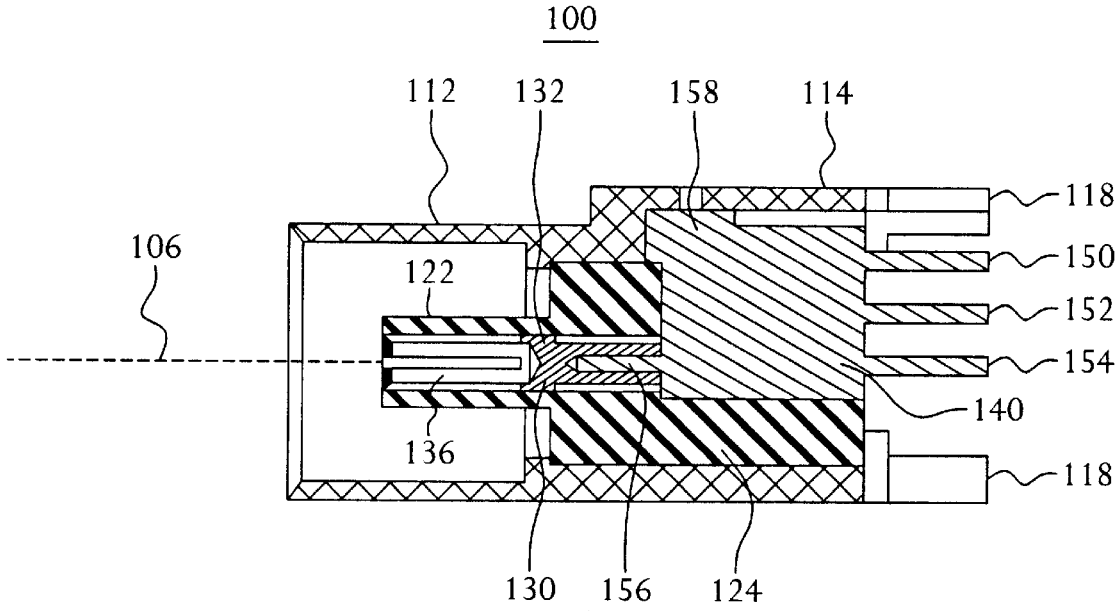

FIGS. 1 through 4 illustrate a preferred embodiment of a connector 100 according to the present invention. FIG. 1 is an isometric view of connector 100; FIG. 2A is an end view of connector 100 looking into its mating end 102; FIG. 2B is an end view of connector 100 looking into its distal end 104; FIG. 3 is an exploded view of connector 100; and FIGS. 4A and 4B are axial cross-sectional views of the connector 100 taken along lines A—A and B—B, respectively, as shown in FIG. 2A.

According to the present invention, connector 100 comprises an outer shell 110 having a mating portion 112 and a body portion 114. Outer shell 110 is made of an electrically conductive material, such as ZAMAK3, and can be manufactured by die casting, for example, or by machining a suitable material, such as brass. Mating portion 112 has a cylindrical outer surface about a connector axis 106. Preferably, mating portion 112 includes a pair of bayonet connector pins 115, and is designed to interlock with a mating BNC type coaxial connector plug disposed as part of a mating coaxial connector (not shown), such as a cable assembly.

Body portion 114 includes a plurality of posts 118 that provide a mechanism to mount connector 100 onto a printed circuit board (PCB). The mounting of connector 100 onto a PCB will be discussed in greater detail below in connection with FIGS. 9A–D.

Connector 100 also comprises an electronic component such as a transformer 140. A suitable transformer 140 is part number 50622 available from Midcom, Inc. of South Dakota. Transformer 140 is disposed within body portion 114 of outer shell 110 and has a plurality of terminals 150, 152, 154, 156, and 158. Terminals 150, 152, and 154 are on the transformer's primary coil, while terminals 154 and 158 are on the secondary coil. The potential difference between terminals 150 and 154, therefore, can be stepped-up or stepped-down relative to the potential difference between terminals 156 and 158. In this way, the input signal and ground paths are isolated from the output signal and ground paths. Preferably, terminal 158 is grounded, and terminal 152 can be a tap.

Inner contact 130 is preferably machined from a suitable electrically conductive material such as beryllium copper. Inner contact 130 has a receiving portion 132 into which transformer terminal 156 is received. Preferably, receiving portion 132 has a cylindrical outer surface about connector axis 106 and is disposed coaxially relative to mating portion 112 of outer shell 110. Inner contact 130 has a hollow interior that is shaped so that terminal 156 fits snugly into receiving portion 132 and is in electrical contact therewith. A ventilation hole 134 provides ventilation during plating and soldering.

Inner contact 130 also has a conventional mating portion 136 that extends from receiving portion 132. Mating portion 136 is substantially a hollow cylinder about connector axis 106 and includes a plurality of slits 137 disposed radially around the perimeter of mating portion 136. The slits 137 help to retain the mating pin contact (not shown) to improve the electrical connectivity between the mating pin contact and inner contact 130.

Connector 100 also includes an insulator 120 disposed between outer shell 110 and inner contact 130. Insulator 120 is made of an electrically insulating material, such as TPX, or TEFLON. Insulator 120 has a contact receiving portion 122 into which mating portion 136 of inner contact 130 is received. Contact receiving portion 122 has a cylindrical outer surface about connector axis 106 and is disposed coaxially relative to mating portion 112 of outer shell 110. Contact receiving portion 122 has a hollow interior that is shaped so that mating portion 136 of inner contact 130 fits snugly into contact receiving portion 122.

Insulator 120 also has a transformer receiving portion 124 into which transformer 140 is received. Preferably, transformer receiving portion 124 is a hollow cylinder having a groove 126. Groove 126 extends axially along at least part of the length, and radially along at least part of the perimeter, of transformer receiving portion 124. Groove 126 is sized and shaped so that when contact 130 and transformer 140 are fitted into insulator 120, transformer 140 fits snugly within groove 126, with transformer face 144 of transformer body 142 abutted against insulator face 128 of insulator 120. Preferably, the length of groove 126 is greater than or equal to the length of transformer body 142 so that transformer body 142 fits completely onto insulator 120.

Groove 126 extends only so far into transformer receiving portion 124 of insulator 120 that receiving portion 132 of inner contact 130 is completely surrounded by transformer receiving portion 124. Thus, insulator 120 surrounds inner contact 130 to insulate inner contact 130 electrically from outer shell 110.

Transformer 140, insulator 130, and inner contact 120 are fitted together and inserted into outer shell 110 as shown in FIGS. 1–4 and described above. Body portion 114 of outer shell 110 is sized and shaped to receive insulator 120, inner contact 130, and transformer 140 so that these components fit snugly into outer shell 110, with insulator 130 holding contact 120 and transformer 140 in place. Preferably, body portion 114 is substantially cubical as shown. With transformer 140 in place within outer shell 110, transformer terminal 158 is received into a notch 108 in outer shell 110 so that terminal 158 is in electrical contact with outer shell 110. Preferably, terminal 158 is soldered to outer shell 110.

In a preferred embodiment, connector 100 is about 0.975 inches from its mating end 102 to its distal end 104. Posts 118 are about 0.140 inches in length. Body portion 114 of outer shell 110 is about 0.555 inches long, and about 0.456 inches by about 0.437 inches in cross-section. Mating portion 112 of outer shell 110 has an outer diameter of about 0.380 inches,not including pins 115. Terminals 150, 152, 154 are about 0.010 inches thick and about 0.024 inches wide. All dimensions provided herein are given to +/−0.001 inches.

Figure 5:
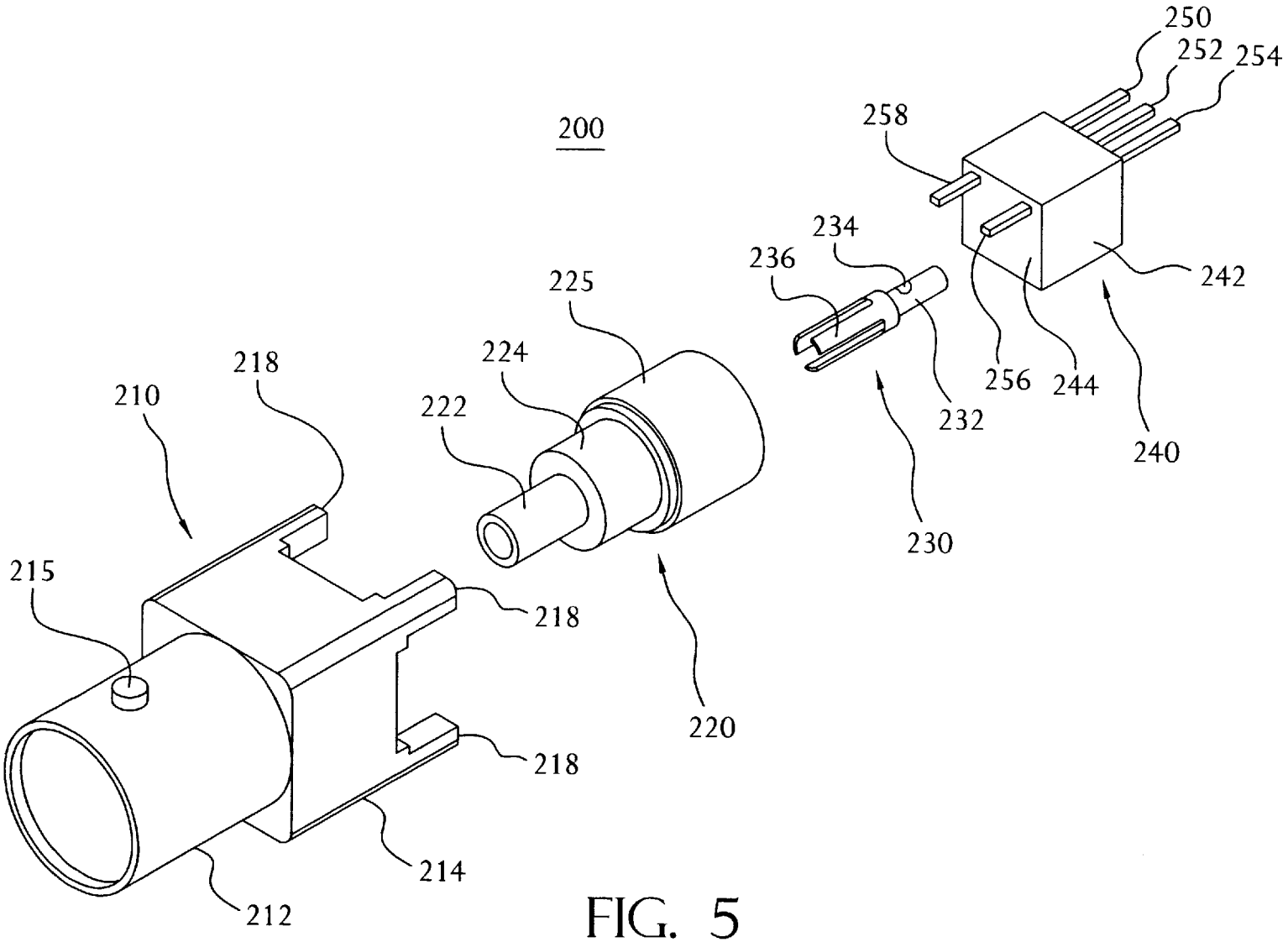
FIG. 5 is an exploded view of another preferred embodiment of a coaxial connector according to the present invention.
Figure 6A:
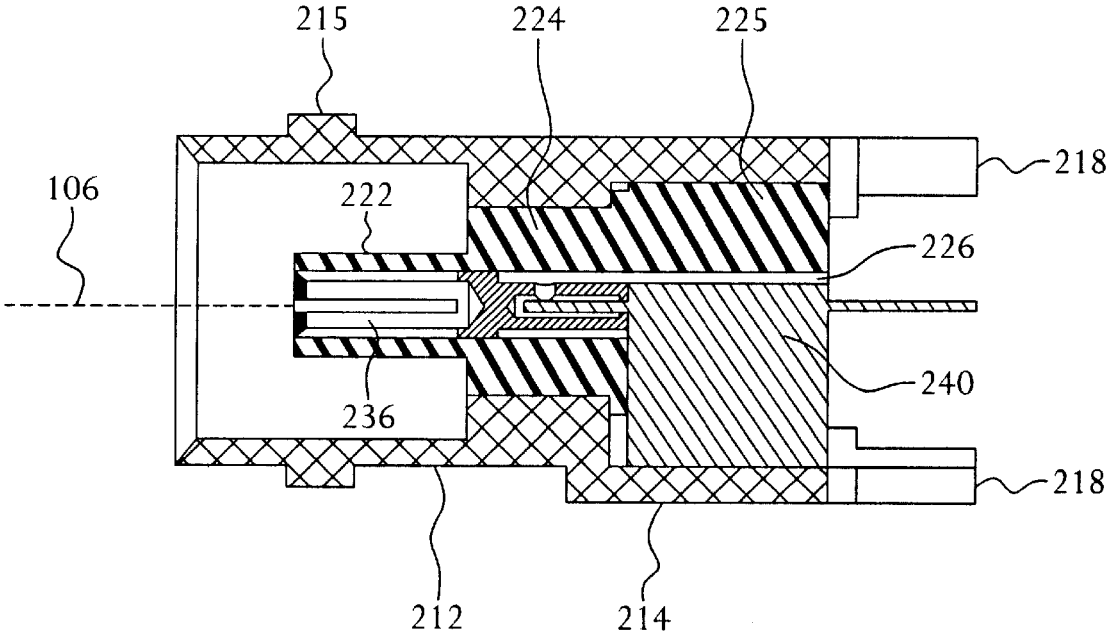
FIGS. 6A and 6B are axial cross-sectional views of the connector shown in FIG. 5.
Figure 6B:
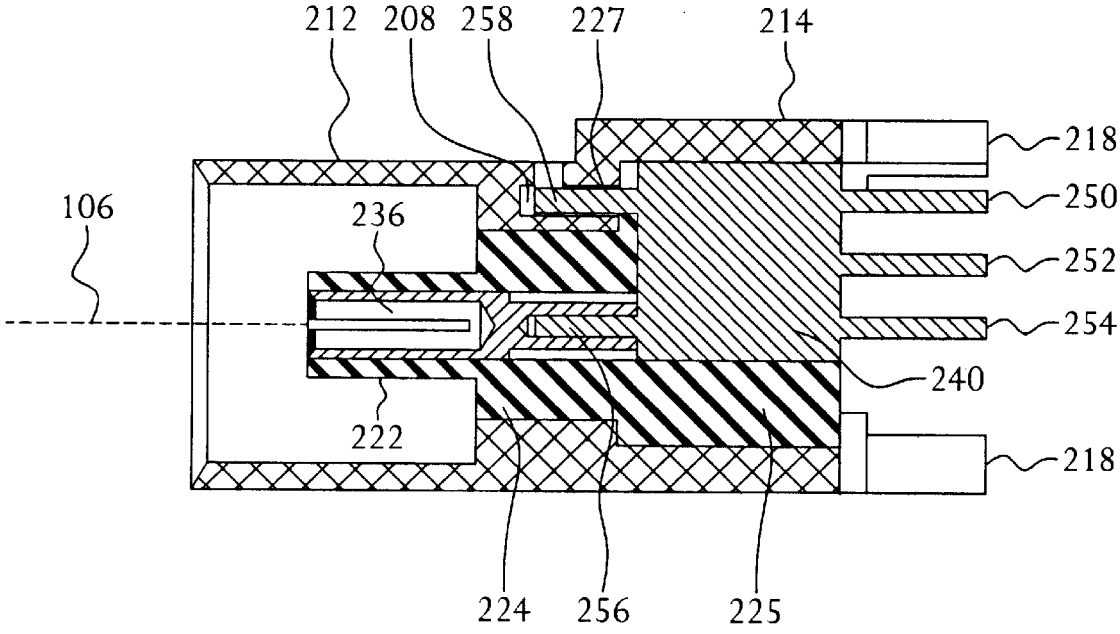

FIG. 5 is an exploded view of another preferred embodiment of a coaxial connector 200 according to the present invention. FIGS. 6A and 6B are axial cross-sectional views of connector 200 taken along lines A—A and B—B, as shown in FIG. 2A, respectively. In this embodiment, inner contact 230 and outer shell 210 are substantially the same as inner contact 130 and outer shell 110 shown in FIGS. 1–4 and discussed above. Transformer 240, however, differs from transformer 140 in that terminal 258 of transformer 240 is substantially straight rather than "L-shaped."

To accommodate transformer terminal 258, insulator 220 comprises a contact receiving portion 222, a first transformer receiving portion 224, and a second transformer receiving portion 225. Contact receiving portion 222 has a cylindrical outer surface about connector axis 206 and is disposed coaxially relative to mating portion 212 of outer shell 210. Contact receiving portion 222 has a hollow interior that is shaped so that mating portion 236 of inner contact 230 fits snugly into contact receiving portion 222.

First transformer receiving portion 224 is a hollow cylinder into which receiving portion 234 of inner contact 230 and transformer terminal 256 are received. Receiving portion 232 of inner contact 230 is completely surrounded by first transformer receiving portion 224. Thus, insulator 220 surrounds inner contact 230 to insulate inner contact 230 electrically from outer shell 210.

Second transformer receiving portion 225 is a hollow cylinder having a groove 226. Groove 226 extends axially along at least part of the length, and radially along at least part of the perimeter, of second transformer receiving portion 225. Groove 226 is sized and shaped so that when contact 230 and transformer 240 are fitted into insulator 220, transformer 240 fits snugly within groove 226, with transformer face 244 of transformer body 242 abutted against insulator face 228 of insulator 220, and transformer terminal 258 extending through a hole 227 in second transformer receiving portion 225. Preferably, the length of groove 226 is greater than or equal to the length of transformer body 242 so that transformer body 242 fits completely onto insulator 220.

Transformer 240, insulator 230, and inner contact 220 are fitted together and inserted into outer shell 210 as shown in FIGS. 5 and 6 and described above. Body portion 214 of outer shell 210 is sized and shaped to receive insulator 220, inner contact 230, and transformer 240 so that these components fit snugly into outer shell 210, with insulator 230 holding contact 220 and transformer 240 in place. With transformer 240 in place within outer shell 210, transformer terminal 258 is received into a notch 208 in outer shell 210 so that terminal 258 is in electrical contact with outer shell 210.

In a preferred embodiment, connector 200 is about 0.923 inches from its mating end 202 to its distal end 204. Posts 218 are about 0.140 inches in length. Body portion 214 of outer shell 210 is about 0.477 inches long, and about 0.428 inches by about 0.430 inches in cross-section. Mating portion 212 of outer shell 210 has an outer diameter of about 0.380 inches, not including pins 215. Transformer terminals 250, 252, 254 are about 0.010 inches thick and about 0.024 inches wide.

Figure 7:
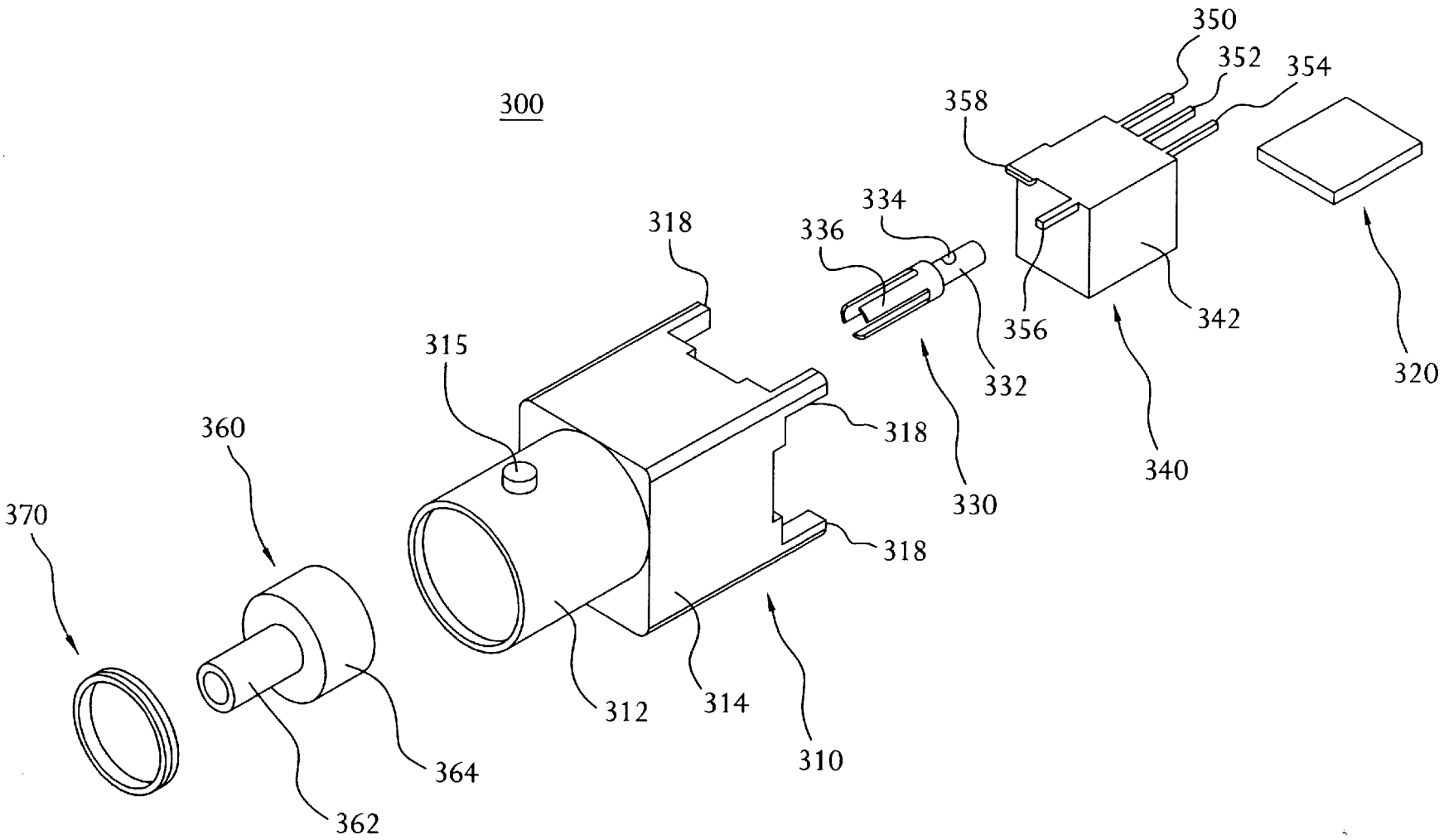
FIG. 7 is an exploded view of another preferred embodiment of a coaxial connector according to the present invention.
Figure 8A:
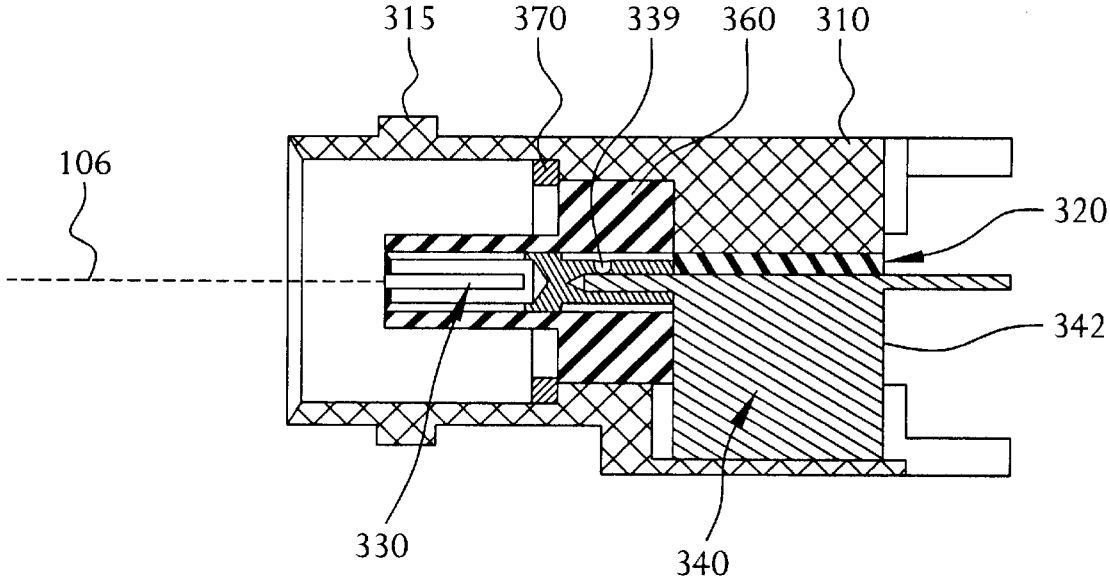
FIGS. 8A and 8B are axial cross-sectional views of the connector shown in FIG. 7.
Figure 8B:
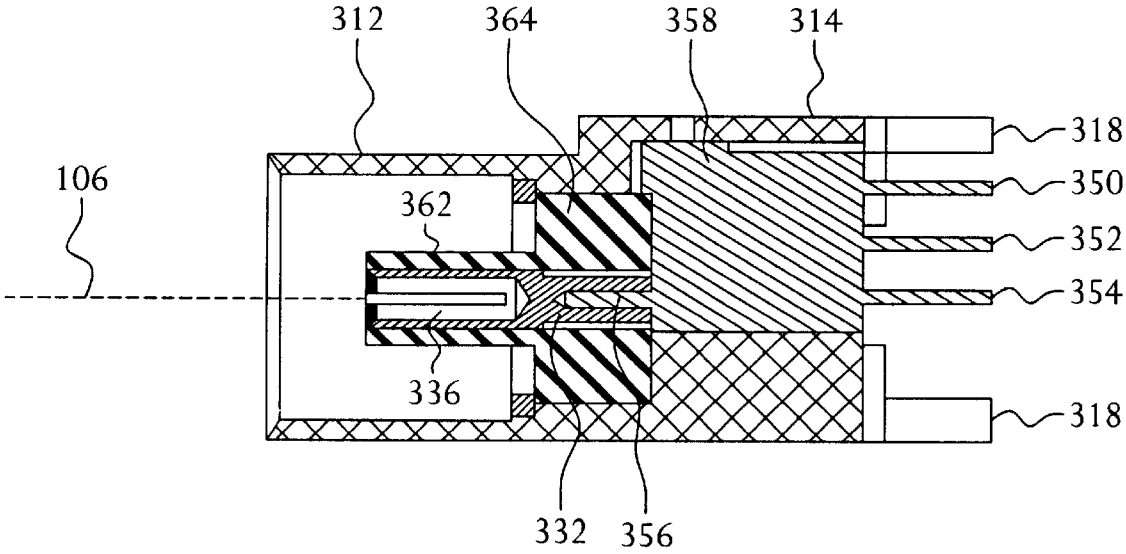

FIG. 7 is an exploded view of another preferred embodiment of a coaxial connector 300 according to the present invention. FIGS. 8A and 8B are axial cross-sectional views of connector 300 taken along lines A—A and B—B, as shown in FIG. 2A, respectively. In this embodiment, transformer 340, contact 330, and outer shell 310 are substantially the same as transformer 140, contact 130, and outer shell 110 shown in FIGS. 1–4 and discussed above. Connector 300 differs from connector 100, however, in that connector 300 includes two insulators 320 and 360, along with a knurl ring 370.

Insulator 320 is an electrically insulating pad that fits snugly between transformer body 342 and outer shell 310 such that insulator 320 holds transformer 340 in place within outer shell 310. Insulator 360 has a contact receiving portion 362 and a transformer receiving portion 364, each of which is basically a hollow cylinder. Insulator 360 receives contact 330 as shown to hold contact 330 and transformer 340 in place within outer shell 310 and to insulate contact 330 from outer shell 310.

When in place within outer shell 310, knurl ring 370 fits around contact receiving portion 362 and abuts transformer portion 364. Preferably, knurl ring 370 has an inner diameter just slightly larger than the outer diameter of contact receiving portion 362 of insulator 360, and an outer diameter just slightly smaller than the inner diameter of mating portion 312 of outer shell 310. Thus, knurl ring 370 holds insulator 320 and inner contact 330 in place within connector 300.

In a preferred embodiment, connector 300 is about 0.975 inches from its mating end 302 to its distal end 304. Posts 318 are about 0.140 inches in length. Body portion 314 of outer shell 310 is about 0.555 inches long, and about 0.456 inches by about 0.429 inches in cross-section. Mating portion 312 of outer shell 310 has an outer diameter of about 0.380 inches, not including pins 315. Transformer terminals 350, 352, 354 are about 0.010 inches thick and about 0.024 inches wide.

Figure 9B:
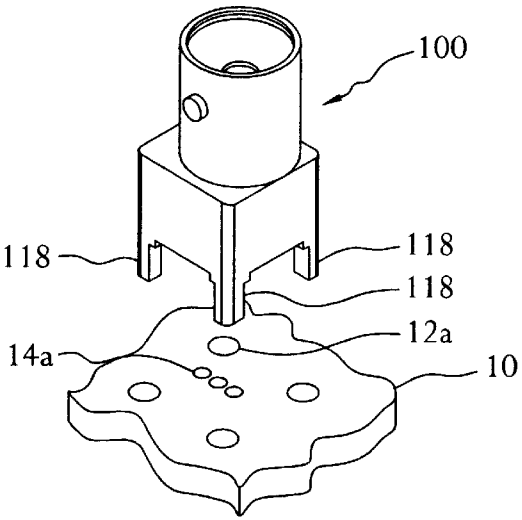
FIGS. 9A–D depict a connector of the present invention being mounted onto a printed circuit board.
Figure 9D:
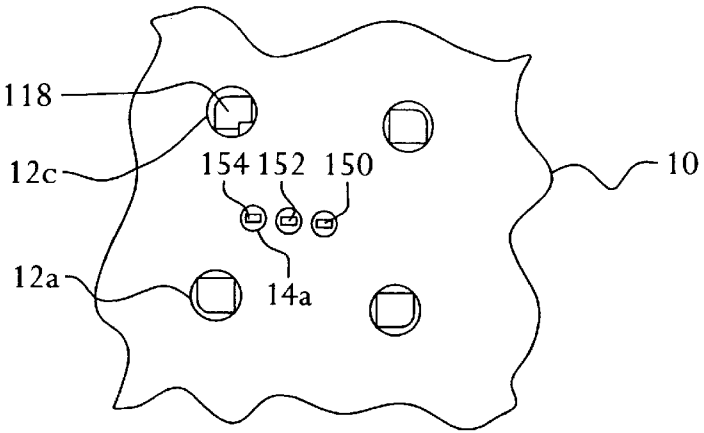
Figure 9A:
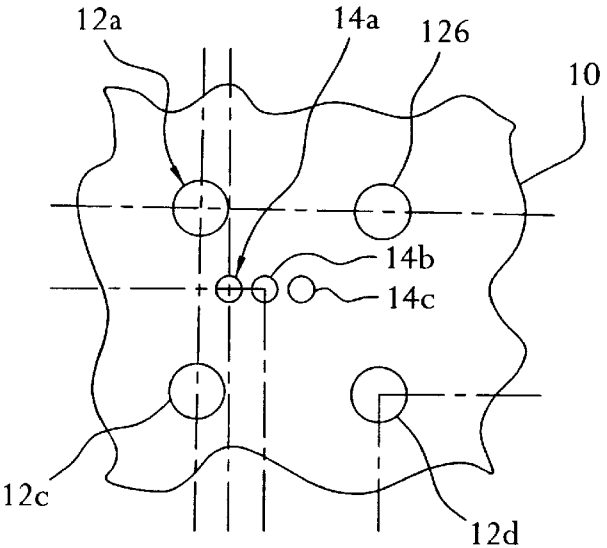
Figure 9C:
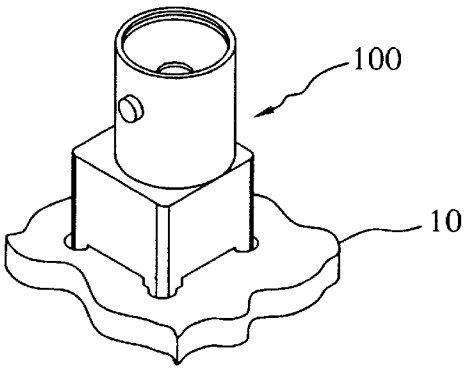

FIGS. 9A–9D illustrate ways in which a connector according to the present invention can be mounted onto a printed circuit board (PCB). FIG. 9A is a view of a portion 10 of a printed circuit board (PCB) suitable for use with a connector according to the present invention. Although any of the connectors described herein can be mounted to a PCB, connector 100 is provided as an example. FIG. 9B depicts a connector 100 being inserted into a PCB portion 10. FIG. 9C is a top-side view of a connector 100 mounted onto a PCB portion 10. FIG. 9D is an underside view of a connector 100 mounted onto a PCB portion 10.

The portion 10 of the PCB onto which connector 100 is to be mounted includes one or more through holes 12 into which posts 118 can be inserted as shown. PCB portion 10 also includes one or more through holes 14 into which transformer terminals 150, 152, and 154 can be inserted as shown. The number and size of through holes 12, as well as the layout thereof, is a function of the size and shape of connector 100. As shown in FIG. 9, four through holes 12*a*–12*d* are required because connector 100 as shown includes four posts 118. Preferably, through holes 12*a* and 12*b* are separated by about 0.365 inches and through holes 12*a* and 12*c* are separated by about 0.363 inches. Similarly, FIG. 9 depicts three through holes 14*a*–*c* because connector 100 as shown includes three transformer terminals 152, 154, 156. Preferably, through holes 14 are typically separated from one another by about 0.073 inches.

Figure 10:
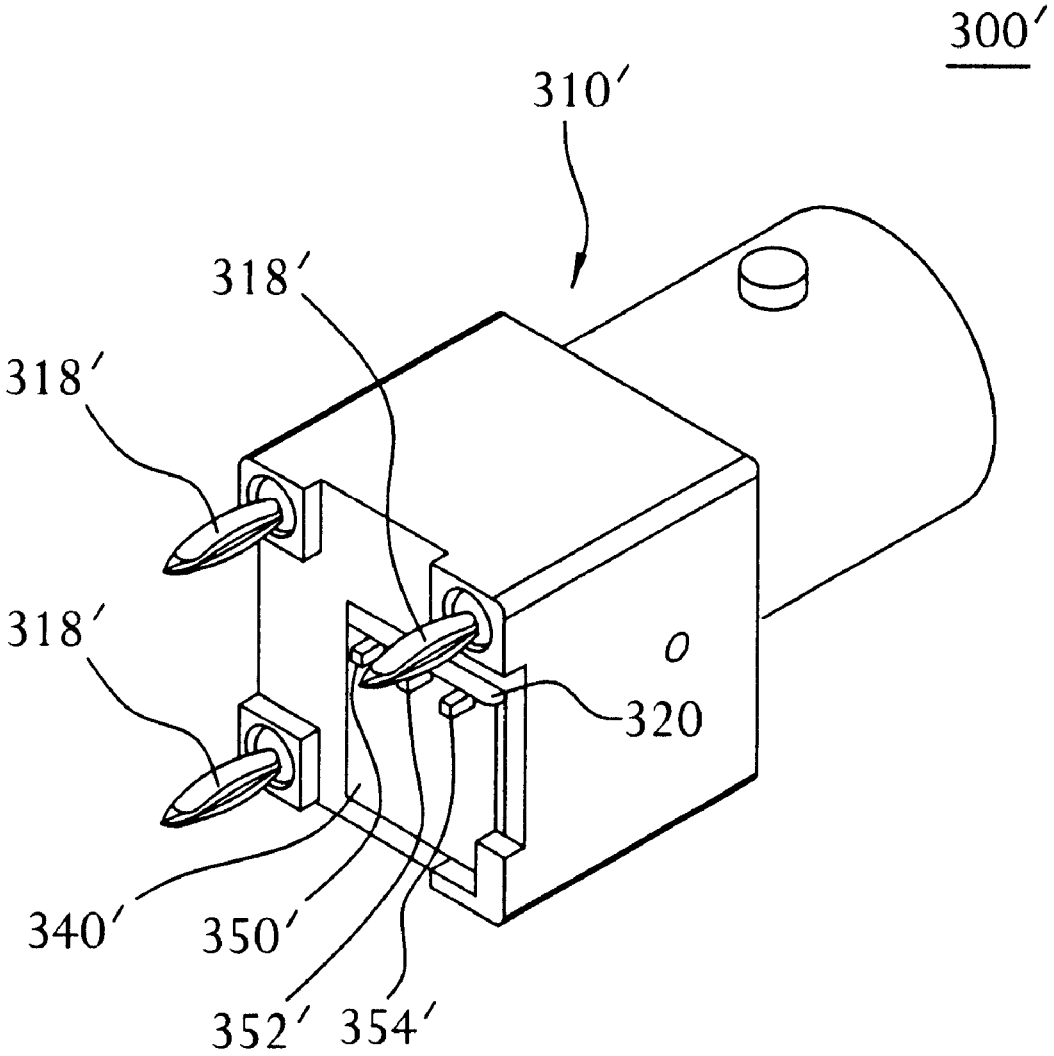
FIG. 10 is an isometric view of another preferred embodiment of a coaxial connector according to the present invention.

FIG. 10 is an isometric view of another preferred embodiment of a connector 300' according to the present invention. As shown, connector 300' is substantially the same as connector 300 described above, except that connector 300' has only three posts 318', each of which is a press-fit post. Posts 318' enable connector 300' to be press fit into through holes on a PCB, such as through holes 12 depicted in FIG. 9. FIG. 10 also shows connector 300' with shortened transformer terminals 350', 352', 354' that are suitable for surface mounting connector 300', as by soldering, onto a PCB.

Those skilled in the art will appreciate that numerous changes and modifications may be made to the preferred embodiments of the invention and that such changes and modifications may be made without departing from the spirit of the invention. For example, it should be understood that any of the above described embodiments can be made with press fit posts, or shortened transformer leads, or both. It is therefore intended that the appended claims cover all such equivalent variations as fall within the true spirit and scope of the invention.

I claim:

1. A coaxial connector mountable to a substrate, comprising:

an electrically conductive inner contact for conducting a signal through the connector;

an electrically conductive outer shell disposed generally coaxially around the inner contact;

an insulator disposed between the inner contact and the outer shell for insulating the inner contact electrically from the outer shell; and an electronic component disposed within the outer shell, having a first terminal in electrical contact with the inner contact, a second terminal in electrical contact with the outer shell, and a third terminal, isolated from the first and second terminals, adapted for electrical contact to the substrate.

2. The connector of claim 1, wherein the outer shell comprises a mating portion having a cylindrical outer surface about a connector axis, and wherein the inner contact comprises a mating portion having a cylindrical outer surface about the connector axis.

3. The connector of claim 1, wherein the inner contact comprises a receiving portion into which the first terminal of the electronic component is received.

4. The connector of claim 1, wherein the insulator comprises a contact receiving portion into which a mating portion of the inner contact is received.

5. The connector of claim 4, wherein the contact receiving portion of the insulator has a cylindrical outer surface about a connector axis.

6. The connector of claim 5, wherein the outer shell comprises a mating portion having a cylindrical outer surface about the connector axis, and wherein the inner contact comprises a mating portion having a cylindrical outer surface about the connector axis.

7. The connector of claim 1, wherein the insulator comprises a component receiving portion into which the electronic component is received such that the insulator holds the electronic component and the inner contact in place within the outer shell.

8. The connector of claim 7, wherein the insulator further comprises a contact receiving portion into which a mating portion of the inner contact is received.

9. The connector of claim 8, wherein the inner contact comprises a receiving portion into which the first terminal of the electronic component is received.

10. The connector of claim 1, wherein the electronic component is a transformer.

11. The connector of claim 1, further comprising:

a second insulator disposed between the electronic component and the outer shell that holds the electronic component in place within the outer shell.

12. The connector of claim 4, further comprising:

a knurl ring disposed between the contact receiving portion of the insulator and the outer shell, wherein the knurl ring holds the insulator in place within the outer shell.

13. The connector of claim 1, wherein the outer shell comprises a plurality of posts for mounting the connector onto a substrate.

14. The connector of claim 13, wherein at least one of the posts is adapted to be press-fit into a through hole on the substrate.

15. The connector of claim 1, wherein at least one terminal of the electronic component is adapted to be surface mounted onto a substrate.

* * * * *